US006141923A

United States Patent [19]

Habicht et al.

[11] Patent Number: 6,141,923

[45] Date of Patent: Nov. 7, 2000

[54] FIRE-RESISTANT FRAME STRUCTURE FOR A FACADE OR GLASS ROOF

[75] Inventors: Siegfried Habicht, Leopoldshöhe; Frank Mantwill, Bielefeld; Armin Tönsmann, Leopoldshöhe, all of Germany

[73] Assignee: Schüco International Kg, Bielefeld, Germany

[21] Appl. No.: 09/049,592

[22] Filed: Mar. 27, 1998

[51] Int. Cl.[7] ..... E04B 2/88; E04B 1/94

[52] U.S. Cl. ..... 52/235; 52/232; 52/407.1; 52/464; 52/764

[58] Field of Search ..... 52/235, 232, 404.1, 52/407.1, 461, 464, 764, 717.02

[56] References Cited

U.S. PATENT DOCUMENTS

| | | | |
|---|---|---|---|
| 3,932,974 | 1/1976 | Wright | 52/235 X |
| 4,557,089 | 12/1985 | Breithaupt | 52/235 |
| 4,638,613 | 1/1987 | Tonsmann | 52/235 |
| 4,650,702 | 3/1987 | Whitmyer | 52/235 X |
| 5,117,601 | 6/1992 | Habicht | 52/717.02 X |
| 5,727,356 | 3/1998 | Ensinger et al. | 52/717.02 |

FOREIGN PATENT DOCUMENTS

3812223A1 11/1989 Germany .

*Primary Examiner*—Robert Canfield
*Attorney, Agent, or Firm*—Henry M. Feiereisen

[57] ABSTRACT

A fire resistant frame structure for a facade or glass roof, includes a column profile, and a beam profile connectable to the column profile to form a support construction and so positioned relative to the column profile as to form spaces for receiving fire protection glasswork. The column profile and the beam rofile are each made of aluminum and comprised of a supporting core member for receiving static loads, an enclosure surrounding the core member, connecting members joining the core member to the enclosure at formation of a hollow chamber, and adsorbent material received in the hollow chamber and having heat absorbing and hydrophilic properties. The connecting members are formed by bridge members which provide a low heat conductivity to effect a low heat flux from the enclosure to the core member. Thus, crystal water can be released when the adsorbent material is subject to a certain temperature level to thereby cool the metallic framework.

48 Claims, 9 Drawing Sheets

FIRE-RESISTANT FRAME STRUCTURE FOR A FACADE OR GLASS ROOF

BACKGROUND OF THE INVENTION

The present invention relates to a fire-resistant frame structure for a facade or glass roof, and in particular to a frame structure of a type having a support construction in the form of column profiles and beam profiles so positioned relative to one another as to form bays for receiving a fire protection glasswork.

German publication DE 38 12 223 A1 discloses a facade of this type and describes column profiles and beam profiles in the form of hollow sections made of aluminum. Inserted in the inner chamber of each hollow section is a reinforcement member of steel and secured therein by screw fasteners. The reinforcement members have a higher melting point than the hollow sections so that in the event of fire, the reinforcement members ensure a static stability over the intended time period commensurate with the desired fire protection class.

It is also known, to completely line, envelope or mask the reinforcement members placed in the inner chambers of the hollow sections with a fire-proof material in order to delay a melting or softening of the hollow sections and to thereby accomplish an extended stability.

These types of fire protection constructions ensure a protection of the hollow sections, by using more temperature-stable materials than aluminum, or by screening the components from direct flames or heat radiation over a desired and given period.

A drawback common to all these conventional fire protection constructions is the need for installation of a great number of structural components that partly are made from different materials and difficult to work with. Moreover, the securement of the reinforcement members within the inner chambers of the hollow sections by means of screws or rivets is cumbersome, and as a consequence of a varying material selection and the need for separate fasteners, the components of the framework cannot be processed together. Moreover, the functionality of such constructions is also impaired as far as transmission of shearing forces or bending forces are concerned in the attachment area of the glass panes as a result of the separately secured reinforcement members.

Temperature fluctuations between conventional facade profiles and incorporated reinforcement members, and possibly varying expansion coefficients of joined workpieces result under the influence of fire in tension which cannot be handled by the screwed connections. Also, the screwed connections exhibit only partially effective shear strength.

SUMMARY OF THE INVENTION

It is thus an object of the present invention to provide an improved frame structure for a facade or glass roof, obviating the afore-stated drawbacks.

In particular, it is an object of the present invention to provide an improved frame structure for a facade or glass roof, which exhibits desired stability, without need for separate reinforcement members, while still allowing use of hollow sections of aluminum and manufacture of closed frameworks with hollow sections that can be treated together and that are suitable for use in fire protection constructions.

These objects, and others which will become apparent hereinafter, are attained in accordance with the present invention by providing the column profile and the beam profile in the form of a supporting core member for receiving static loads, an enclosure surrounding the core member, connecting members for joining the core member to the enclosure so as to form a hollow chamber therebetween, and adsorbent material received in the hollow chamber and having heat absorbing and hydrophilic properties, with the connecting members providing a low heat conductivity to effect a low heat flux from the enclosure to the core member.

Preferably, the connecting members extend at the glasswork proximate end of the hollow chamber, with at least part of each connecting web forming a bottom of a groove that receives a bead of sealing material to support the glasswork. The bottom of the groove is preferably provided with a plurality of spaced punched holes, with bridges being formed between successive punched holes to ensure a reduced heat flux from the enclosure to the core member. The enclosure may suitably be formed by a U shaped box, and the core member may be formed by a rectangular hollow section.

According to another feature of the present invention, the core member and the enclosure are each formed in single piece construction from an extruded aluminum profile, whereby the core member may have a wall thickness which is greater, preferably by a multiple, than the wall thickness of the enclosure.

Preferably, the adsorbent material may be constituted by a formed body made of heat-absorbing, hydrophilic adsorbing substance with high water content, or by a formed body containing a heat-absorbing hydrophilic adsorbing substance. Spring members are suitably used to secure the adsorbent material in place in a force-locking manner within the hollow chamber.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
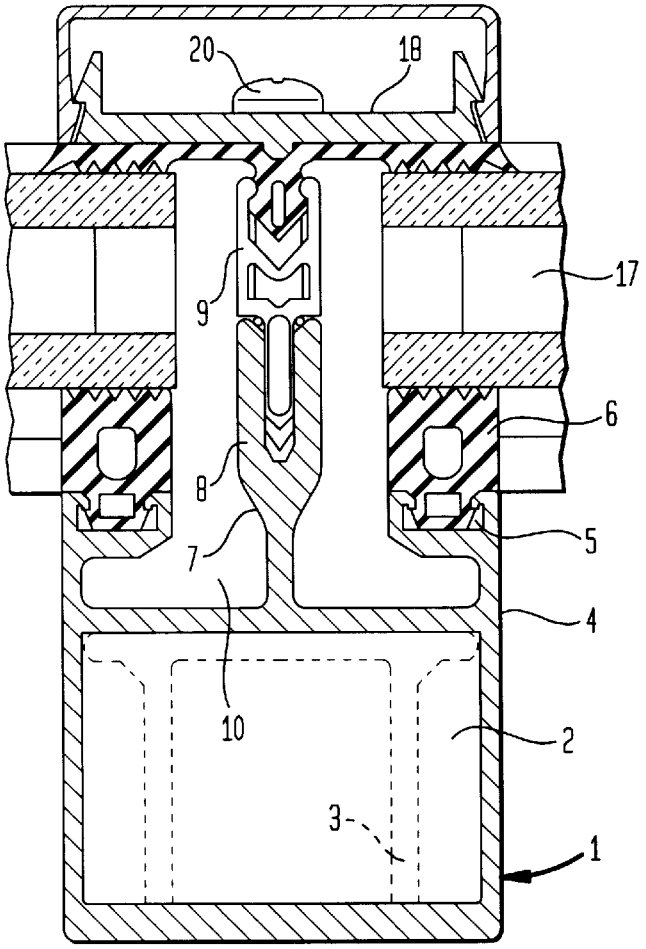
FIG. 1 (PRIOR ART)
FIG. 1 is a schematic illustration of an aluminum column profile forming one part of a conventional frame structure.

Throughout all the Figures, same or corresponding elements are generally indicated by same reference numerals.

Figure 2:
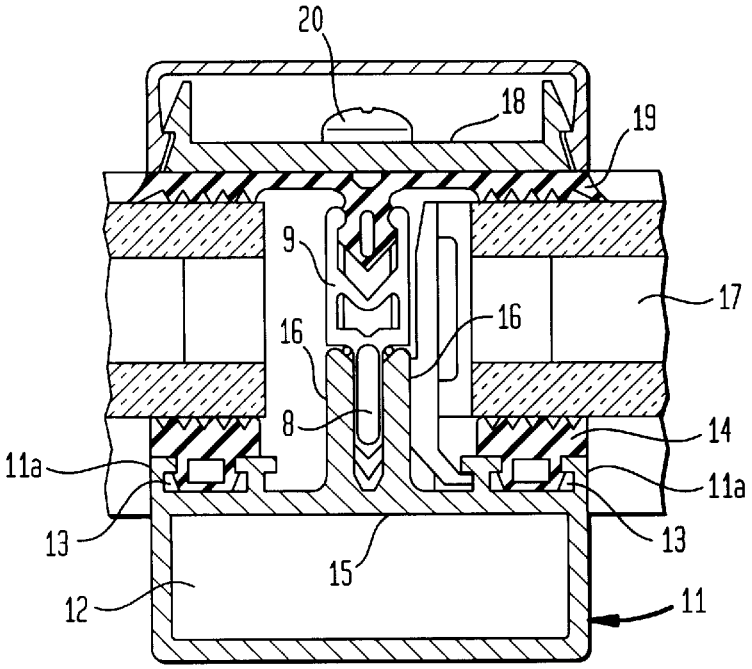
FIG. 2 (PRIOR ART)
FIG. 2 is a schematic illustration of an aluminum beam profile forming another part of the conventional frame structure.

Turning now to the drawing, and in particular to FIGS. 1 and 2, there are shown schematic illustrations of a column profile, generally designated by reference numeral 1 and a beam profile, generally designated by reference numeral 11 as currently used in conventional fire protection facades of aluminum.

The conventional column profile 1 is shown in FIG. 1 and includes a hollow chamber 2 which are exploited for installation of reinforcement members 3, shown in broken lines only. The column profile 1 includes lateral longitudinal arms 4 that form at their ends grooves 5 for receiving beads 6 of sealing material for support of a glasswork such as glass panes 17. Provided in a central area between the lateral longitudinal arms 4 is an anchoring member 7 which is configured in the form of a tuning fork and forms a threaded bore 8 for receiving a screw fastener 20 and at the same time a foot of an isolating bar 9 which is so sized as to almost completely fill the glass rebate between the glasswork 17, i.e. the cutout shape of the frame to accommodate the glazing 17 and the beads 6. The anchoring member 7 and the longitudinal arms 4 form together drainage passageways 10.

The conventional beam profile 11 is shown in FIG. 2 and is formed by a hollow section having a hollow chamber 12. Formed on the top wall 15 along each longitudinal side of the hollow section are two pairs of facing flanges 11*a*which flank respective grooves 13 for receiving beads 14 of sealing material for support of a glassworks 17 arranged in symmetric disposition with respect to the center plane of the beam profile 11. The glasswork-facing top wall 15 not only forms the bottom of the grooves 13 but at the same time also defines a base for two parallel webs 16 which together form a threaded bore 8 for receiving a screw fastener 20 and the foot of an isolating bar 9. The connection between the beam profile 11 and the column profile 1 is effected by so notching the hollow chamber 12 underneath the wall 15 that the wall 15 bears upon the flanges 11*a* of the grooves 5 and project to the area of the drainage passageways 10, with the beam profile 11 being secured to the column profile 1 by means of an additional connector.

In order to provide a leveled common surface for the plate-shaped glasswork 17, the heights of the beads 14 of the beam profile 11 and the beads 6 of the column profile 1 are different to suit one another. The glasswork 17 is retained in such facade constructions by clamping the glasswork 17 upon the subassembly of column profile 1 and beam profile 11 by means of a pressure element 18 via a seal 19, with the pressure element 18 and the seal 19 being secured by the screw fasteners 20 which are received in the bores 8 of the column profile 1 and the beam profile 11.

Figure 3A:
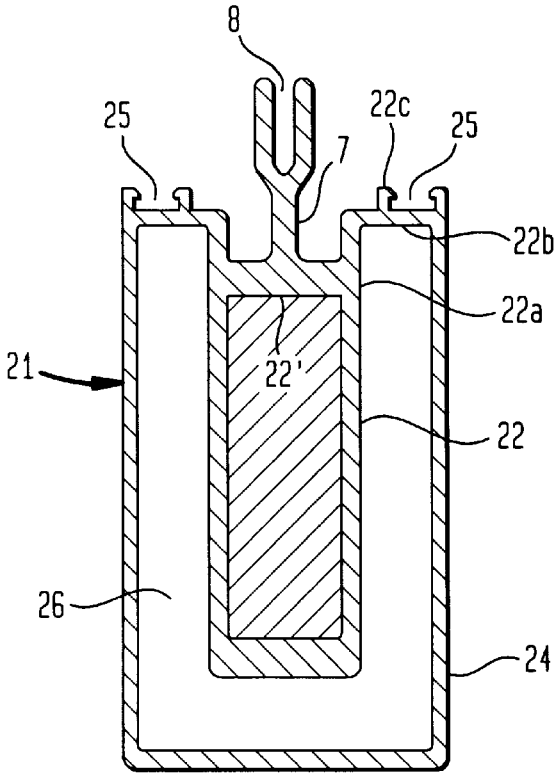
FIG. 3*a* is a schematic illustration of another embodiment of a column profile according to the present invention.
Figure 3:
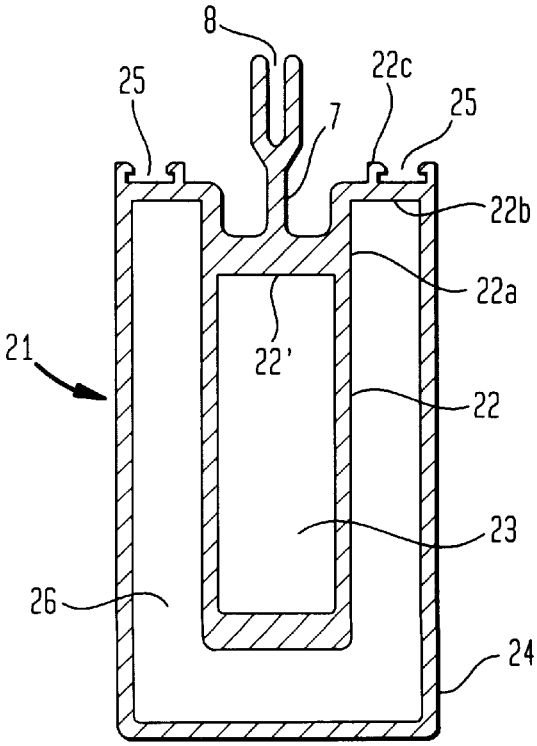
FIG. 3 is a schematic illustration of one embodiment of a column profile according to the present invention.
Figure 5:
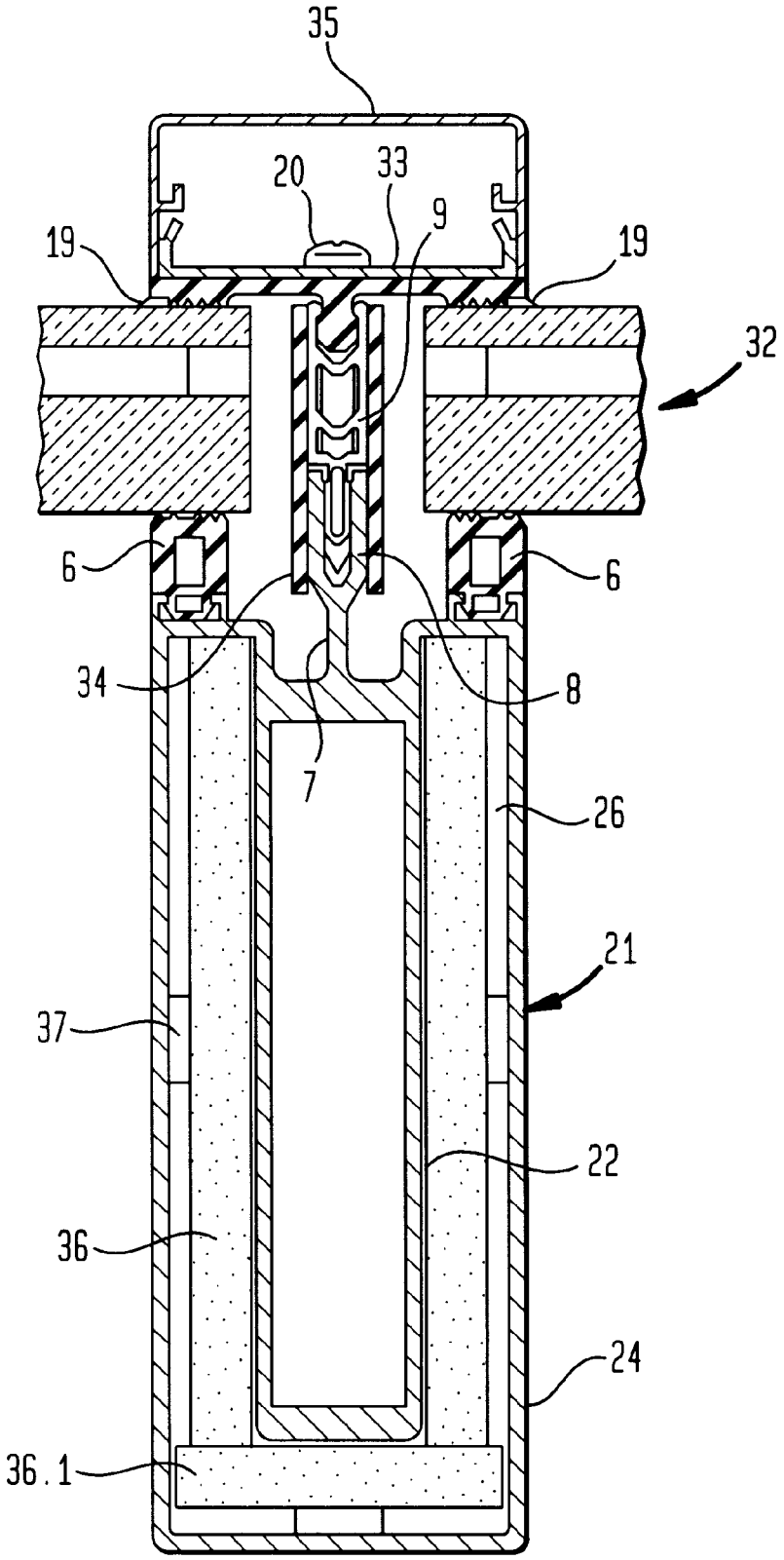
FIG. 5 is a partially sectional view of the column profile of FIG. 3 as part of a fire protection facade in assembled state.

Turning now to FIG. 3, there is shown a schematic illustration of one embodiment of a column profile according to the present invention, generally designated by reference numeral 21. The column profile 21 is comprised of a core section 22, preferably of rectangular configuration, and an enclosure 24 of substantially U-shaped configuration. The core section 22 is shown as including a hollow chamber 23; however, it is certainly within the scope of the present to provide also a solid core profile as shown by way of example in FIG. 3*a*. Projecting outward from a bridge 22' of the core section 22 is a central anchoring web 7 which is formed as a tuning fork and defines a threaded bore 8 for engagement by a screw fastener 20 (FIG. 5). The bridge 22' extends slightly shy of the axial end of the core section 22 which thus has lateral walls 22*a* jutting outwards beyond the bridge 22'. The core section 22 is so configured and sized as to absorb static loads of the facade or glass roof not only during normal conditions but also under the influence of fire.

The core section 22 is surrounded by the enclosure 24 at formation of a U-shaped hollow chamber 26. The legs of the U-shaped enclosure 24 are so sized as to slightly extend beyond the wall 22*a* of the core section 22 in direction to the glasswork side, whereby bridges 22*b* are formed between the walls 22*a* and the enclosure legs to join the enclosure 24 to the core section 22 so that the bridges 22*b* directly bound the U-shaped hollow chamber 26. The bridges 22*b* form a bottom of grooves 25 which are flanked by the legs of the enclosure 24 and inverted L-shaped flanges 22*c* formed on the bridges 22*b*. Received in the grooves 25 are the beads 6 of sealing material for support of the glass panes 17.

In the embodiment of FIG. 3, the core section 22 and the U-shaped enclosure 24 are made from a single-piece aluminum extrusion. Suitably, the wall thickness of the core section 22 exceeds the wall thickness of the enclosure 24, preferably by a multiple. Although in view of its thin wall configuration, the enclosure 24 contributes only to a minor extent to the static of the column profile 21, the overall small mass of the enclosure 24 effects also a low heat storage capability.

Figure 4:
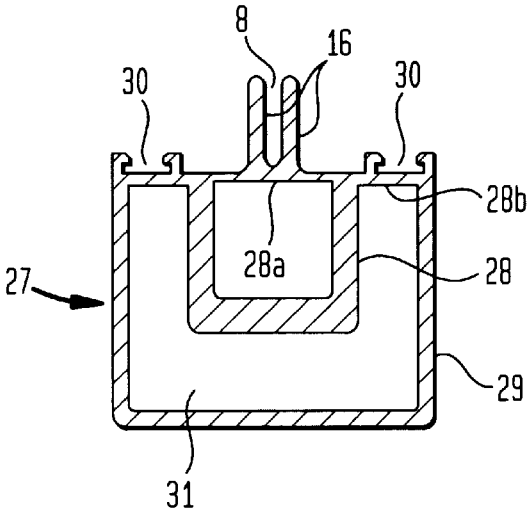
FIG. 4 is a schematic illustration of one embodiment of a beam profile according to the present invention.

FIG. 4 shows one embodiment of a beam profile according to the present invention, generally designated by reference numeral 27 to complement the column profile 21 of the frame structure for a facade or glass roof. The beam profile 27 has a core section 28 of a configuration complementing the core section 22 of the beam profile 21 and is thus, preferably, of rectangular shape. The core section 28 of the beam profile 27 may be hollow or solid, and formed in one piece with parallel webs 16 projecting outwards from a top wall 28*a* of the core section 28 and forming a threaded bore 8. The core section 28 is surrounded by a U-shaped enclosure 29 which is connected to the core section 28 via bridges 28*b*, thereby defining a hollow chamber 31 between the core section 28 and the enclosure 29. On the side facing the glasswork, the core section 28 is formed with grooves 30 for receiving beads of sealing material for support of the glasswork. The enclosure 29 has a wall thickness which is smaller than the wall thickness of the core section 28.

As shown in FIG. 4, the bridges 28*b* and thus the bottom of the grooves 30 are substantially in alignment with the bridge wall 28*a* of the core section 28 so that through respective notching the aligned walls 28*a*, 28*b* will rest in the junction area between the beam profile 27 and the column profile 21 on the flanges flanking the grooves 25 of the column profile 21.

The core section 28 and the enclosure 29 of the beam profile 27 are made from a single piece aluminum extrusion, in a same manner as described in connection with the column profile 21.

Turning now to FIG. 5, there is shown a partially sectional view of the column profile 21 of FIG. 3 as part of a fire protection facade in assembled state. The column profile 21 is provided with beads 6 for support of a fire-proof glasswork 32, with the beads 6 being secured in the grooves 25. Bearing upon the beads 6 of the column profile 21 and upon the beads 14 of the beam profile 27 is the fire protection glasswork 32 which, as shown in FIG. 5, is combined with an insulating glazing. The threaded bore 8 receives an isolator bar 9 which is secured by the screw fastener 20 that also mounts a pressure plate 33 and a seal 19 placed under the pressure plate 33. The isolator bar 9 and the anchoring web 7, shaped in the form of a tuning fork, forms a glass rebate separation between the single glass panes of the fire-protection glasswork 32. Provided on both sides of the separation are fire protection strips 34 which bloat during fire under the influence of temperature to seal the glass rebate and the glasswork 32 from the outside and thereby block access of hot fumes to the glass rebate. As further shown in FIG. 5, the area of the glass rebate may be screened from outside by a masking plate 35 which is snapped onto the pressure plate 33.

The U-shaped chamber 26 between the core section 22 and the enclosure 24 is filled partially or completely with slabs or other formed bodies 36, 36.1 which are made of heat-absorbing, hydrophilic adsorbent material with high water content or with slabs or formed bodies that contain such adsorbent materials. The slabs or formed 36, 36.1 bodies are pushed into the U-shaped hollow chamber and secured in a force-locking manner by spring elements 37.

Figure 12:
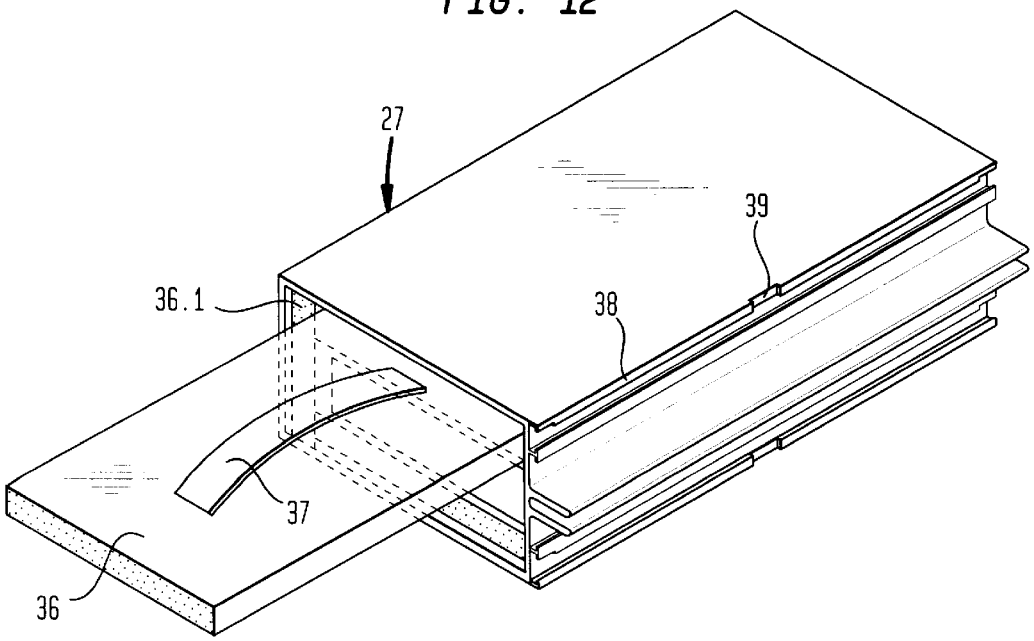
FIG. 12 is a schematic, perspective illustration of a variation of the column profile of FIG. 4.

In a same manner as the column profile 21, the beam profile 27 has incorporated in the U-shaped hollow chambers 31, partially or fully filled, slabs or formed bodies 36 of heat-absorbing, hydrophilic adsorbent material with high water content, as best seen in FIG. 12, with spring elements 37 securely keeping the slabs 36 in place.

The adsorbent material 36, 36.1 placed in the U-shaped hollow chambers 26 (FIG. 3) of the column profile and the adsorbent material placed in the U-shaped hollow chambers 31 of the beam profile 27 acts as energy dissipater, unlike fire protection screens, i.e. absorption of energy by the adsorbent material results only in a slight temperature rise of the fire protection facade profiles over a targeted and predetermined period. As the temperature rise of the facade profiles until reaching the melting temperature of aluminum is delayed over an extended period, the stability of the column core section 22 or beam core section 28 is ensured commensurate with the time allowed by the fire protection classification. Activation of the hydrophilic slabs 36, 36.1 of adsorbent material requires a certain temperature transfer upon the column core section 22 and the beam core section 28 to enable a reaction of the adsorbent material.

This slight heat conduction from the outside wall of the hollow chamber 26; 31 to the core section 22; 28 is effected by the bridges 22*b*; 28*b* between the outside wall 26; 31 and the core sections 22; 28. The bridges 22*b*; 28*b* may be formed as walls that flank the hollow chambers 26; 31 at the glasswork proximate side.

Figure 6:
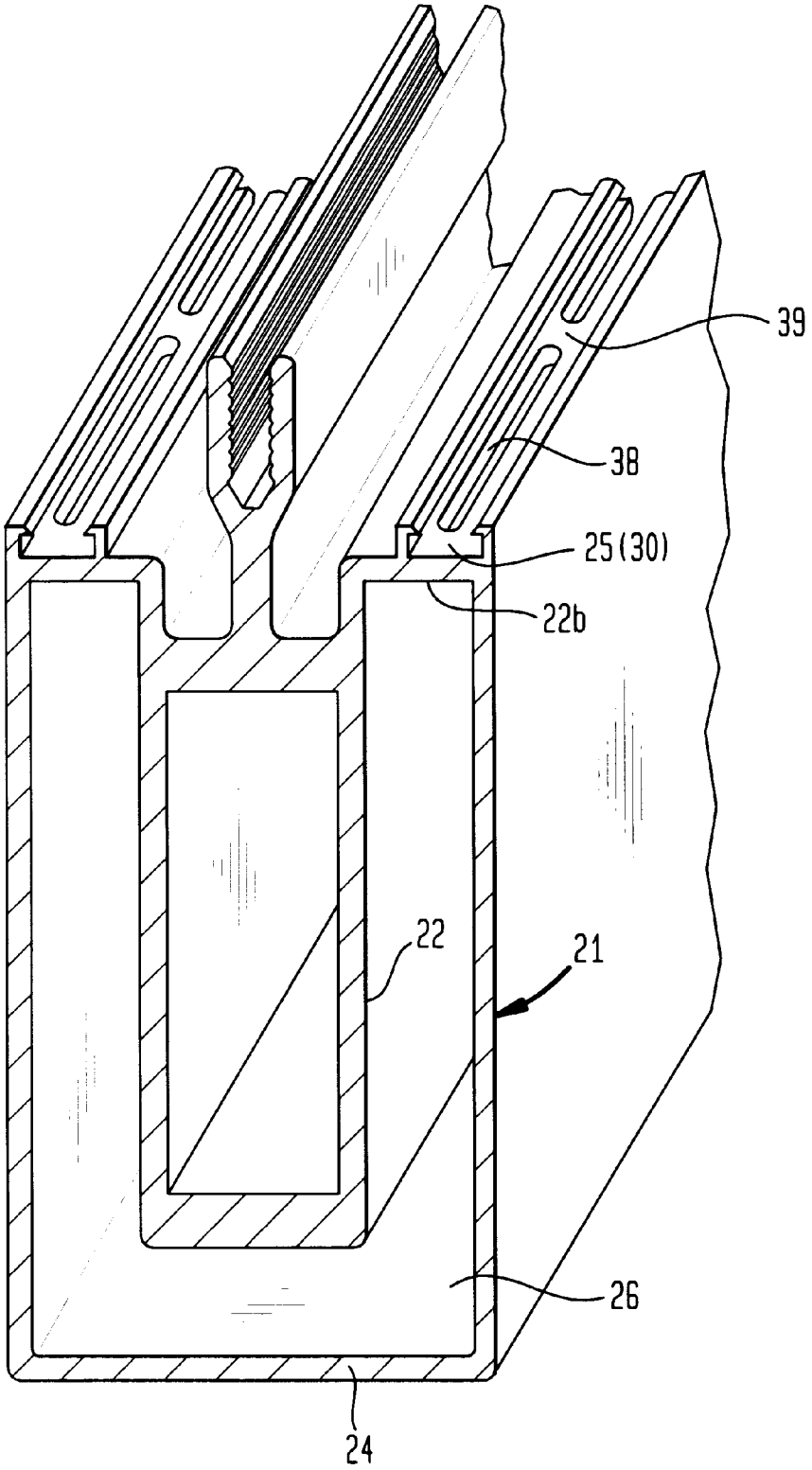
FIG. 6 is a perspective, sectional view of another embodiment of a column profile according to the present invention.

FIG. 6 shows a column profile 21 with core section 22 and enclosure 24 being made in one piece of aluminum. The bridges 22*b* providing the base of the grooves 25 are formed in one piece with the core section 22 and the enclosure 24 and include punched holes 38 which are arranged sequentially in longitudinal direction of the column profile 21 and separated from one another by webs 39. Through the formation of punched holes 38 the heat conduction and heat flux to the webs 39 from the outside wall of the hollow chamber 26 to the core section 22 is limited to the webs 39 and thus reduced. These webs 39 do not serve as heat insulation of the facade with regard to the glasswork plane but solely are provided to minimize the heat flux from the enclosure 24 to the core section 22 in the event of fire.

Although not shown in detail, the core section 28 of the beam profile 27 is formed in a same manner as the core section 22 of the column profile 21 and may have punched holes to generate the same effect, as described above.

Figure 7:
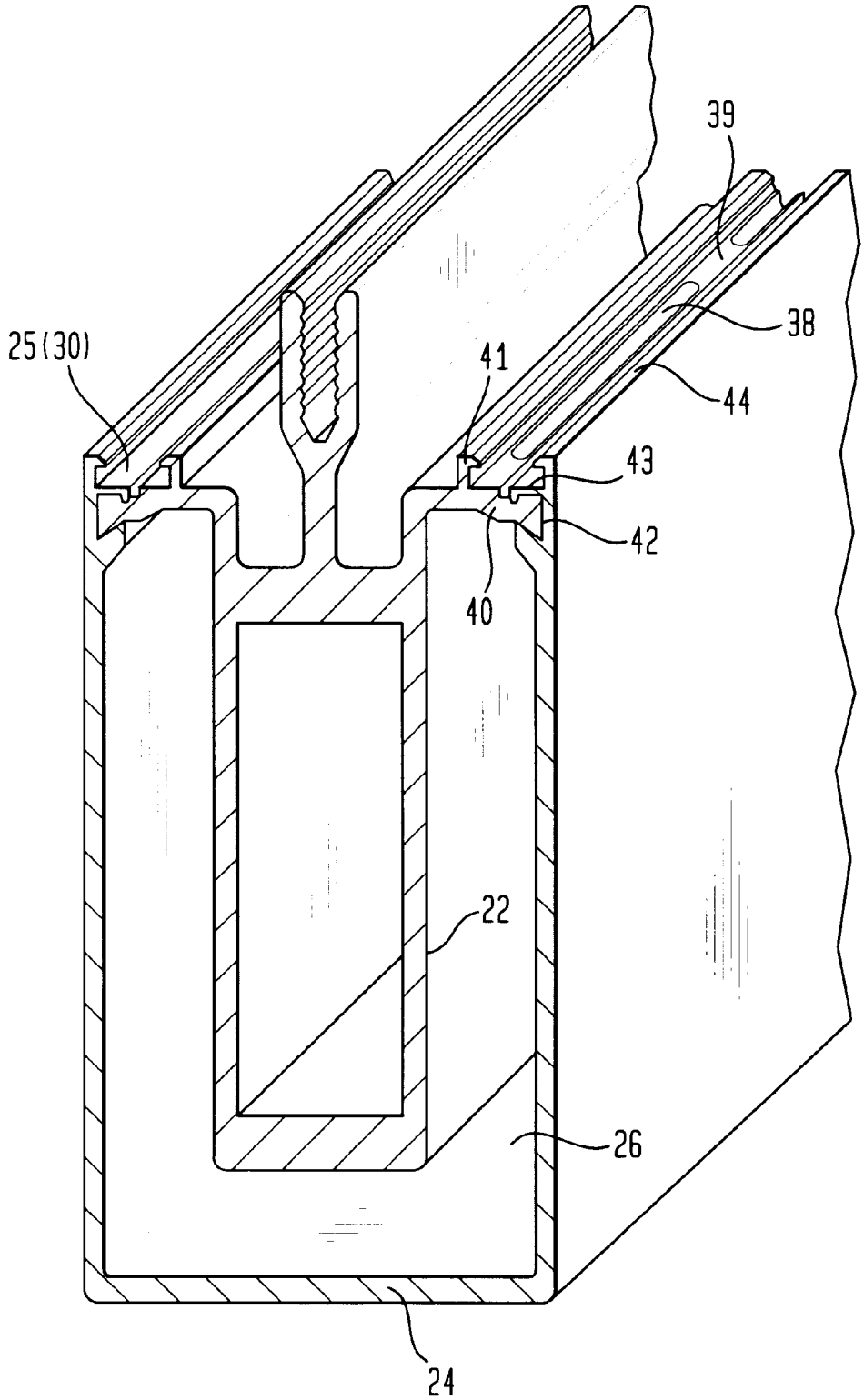
FIG. 7 is a perspective, sectional view of still another embodiment of a column profile according to the present invention.

FIG. 7 shows a modification of the column profile 21, with the difference to the embodiment shown in FIG. 6, residing in the formation of anchoring arms 40 in the transition between the core section 22 to the enclosure 24. The anchoring arms 40 have one end formed in one piece with the core section 22 and project outwardly from the core section 22. The other end of the anchoring arms 40 are formed as a longitudinal prismatic edge region for engagement in a complementary groove 42 of the enclosure 24, with the edge regions of the anchoring arms 40 being secured through rolling attachment of a flange 43 which defines the groove 25 and projects inwardly from the enclosure 24. The groove 25 for receiving the bead of sealing material is further flanked by a flange 41 formed in one piece with the anchoring arm 40. Although not described in detail, the core section 28 of the beam profile 27 is connected to the enclosure 29 in a same manner as set forth in connection with the column profile 21.

In the area of the anchoring arm 40 that also forms the base of the grooves 25 (and 30), may be formed with punched holes 38, with webs 39 being formed between successive punched holes 38.

Figure 8:
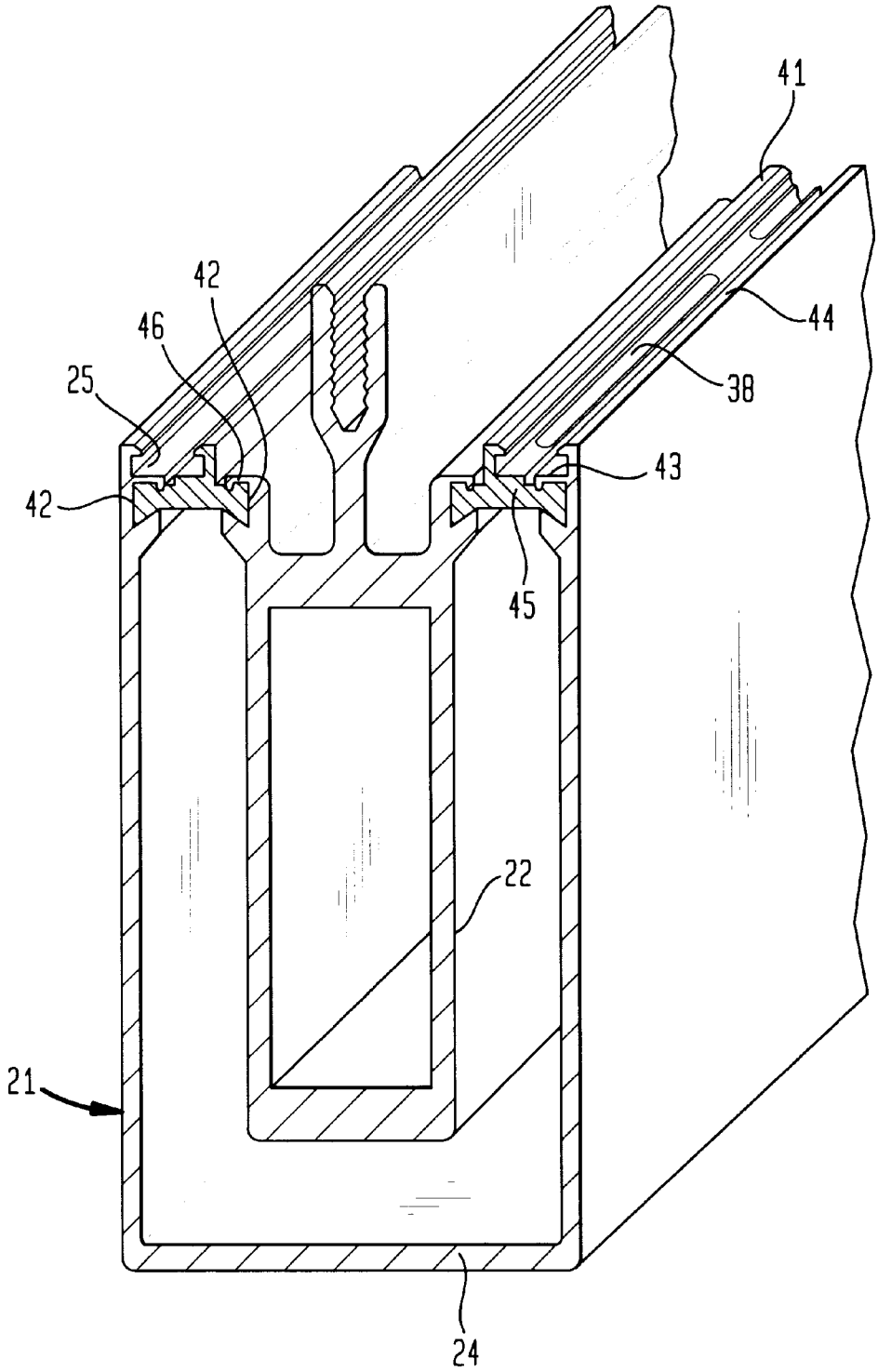
FIG. 8 is a perspective, sectional view of still another embodiment of a column profile according to the present invention.

FIG. 8 shows a further variation of the column profile 21 in which the core section 22 and the enclosure 24 are connected to one another by separate bridges in the form of metal strips 45 which are received in facing grooves 42 of the core section 22 and the enclosure 24. The metal strips 45 are each formed with longitudinal edge regions of trapezoidal configuration which engage in form-fitting manner in the grooves 42 and are secured therein through interlocking engagement of a flange 43 of the enclosure 24 and a flange 46 of the core section 22, respectively. Projecting outwardly from each metal strip 45 is a skirt 41 that flanks one longitudinal side of the groove 25 for receiving the bead 6 of sealing material, while the other longitudinal side of the groove 25 is flanked by a flange 44 formed in one piece with the enclosure 24. In analogous manner as described in connection with FIGS. 6 and 7, the metal strip is formed with punched holes 38 arranged in tight sequence in longitudinal direction.

Figure 9:
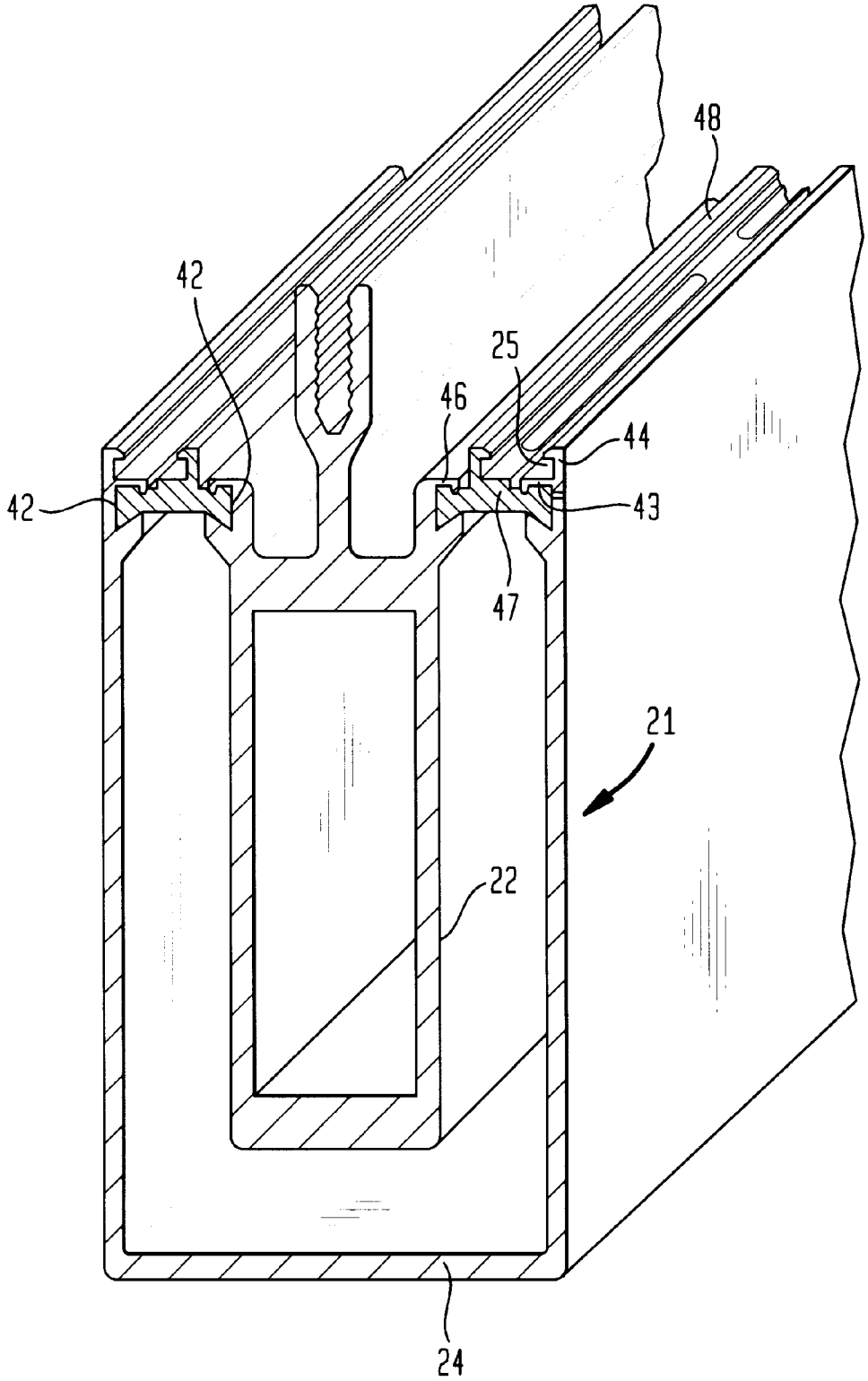
FIG. 9 is a perspective, sectional view of still another embodiment of a column profile according to the present invention.

FIG. 9 shows another variation of a column profile 21 according to the present invention which includes instead of the metal strip 45 a connection strip 47 made of poor heat conducting plastic material for linking the core section 22 with the enclosure 24. The connection strip 47 is formed with a skirt 48 projecting outwardly from the connection strip 47 and bounding with the parallel flange 44 of the enclosure 24 the groove 25 for receiving the bead 6 of sealing material for support of the glass pane.

Figure 10:
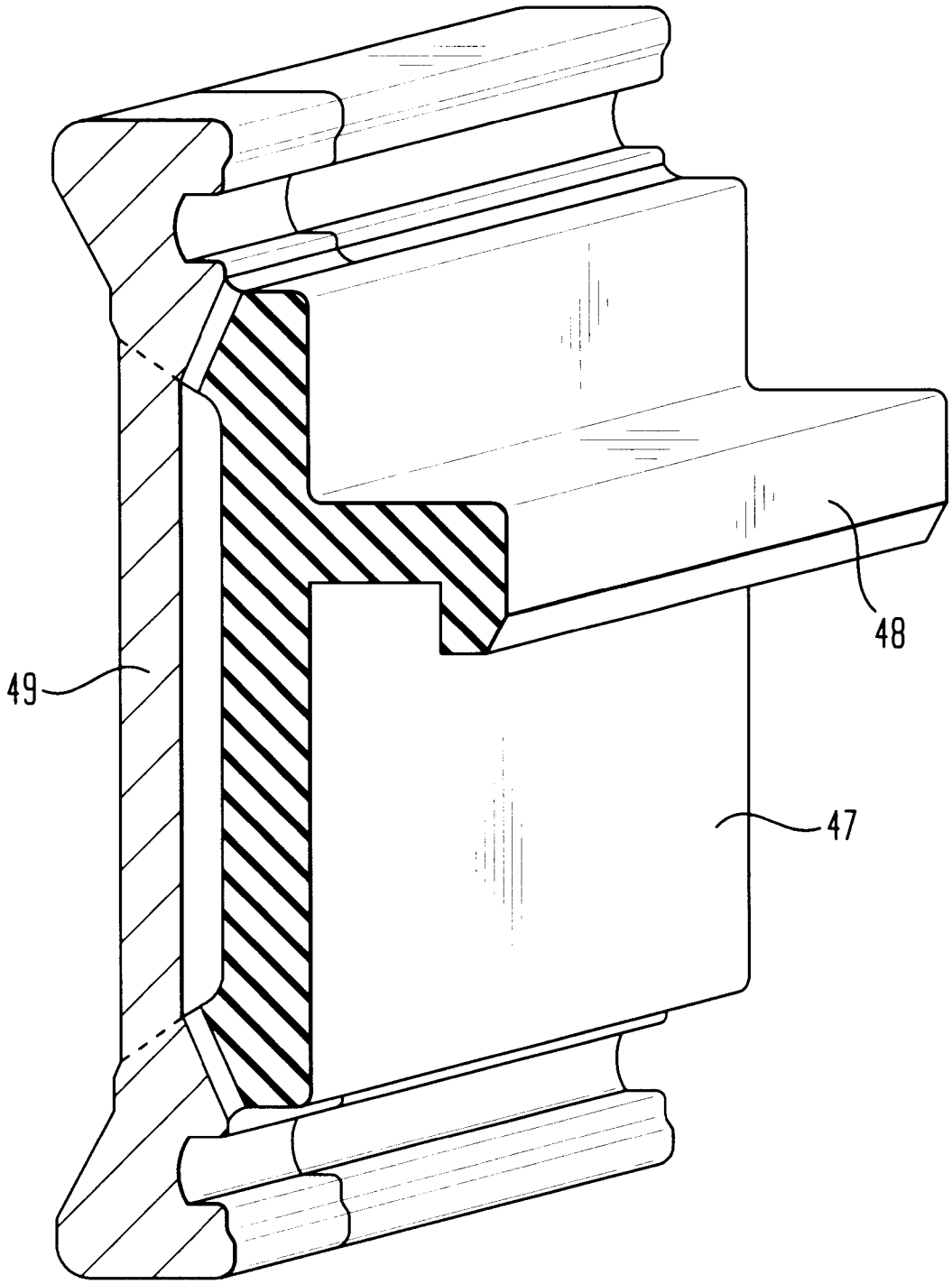
FIG. 10 is a perspective, sectional cutaway view on an enlarged scale of a connection strip for use in the column profile of FIG. 9 in combination with a bridge panel.

An exemplified embodiment of the connection strip 47 is shown in FIG. 10 on an enlarged scale. The connection strip 47 is formed with longitudinal edge regions of trapezoidal configuration which are so notched in areas thereof as to enable attachment of metallic bridge panels 49 (only one is shown in FIG. 10), with the bridge panels 49 maintaining a low heat flux between the core section 22 and the enclosure 24. This type of configuration is also applicable to the beam profile 27.

Figure 11:
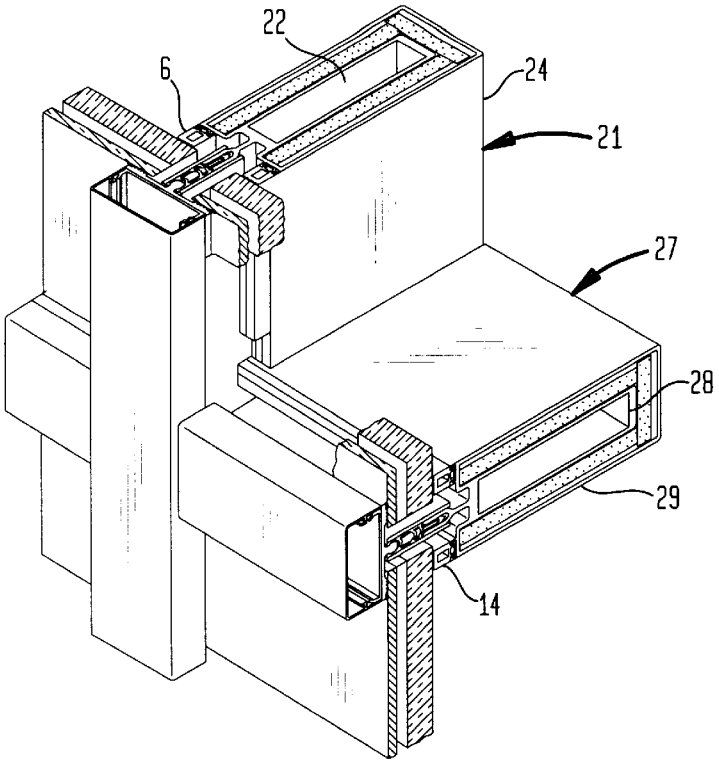
FIG. 11 is a schematic, perspective illustration of a frame structure in accordance with the present invention for use as fire resistant facade and showing in detail the connection in a junction area between a column profile and a beam profile.

FIG. 11 shows a perspective view of a crossing point between a column profile 21 and a beam profile 27. In the butt area, the beam profile 27 overlaps the column profile 21 over the entire projection width and extends beyond the bead receiving grooves 25 of the column profiles 1 so that drain or leakage water can flow from the gutter of the beam profiles 27 into the gutter of the column profiles 21, without requiring notching or milling of the column profile. The core section 22 of the column profile 21 and the core section 28 of the beam profile form support components of the framework for carrying the entire fire-protection glasswork, while the enclosure 24 of the column profile 21 and the enclosure 29 of the beam profile 27 only assume the task of encapsulating the heat-absorbing, hydrophilic slabs or formed bodies 36, 36.1 so that the facade structure receives an outwardly closed and pleasing look.

While the invention has been illustrated and described as embodied in a fire-resistant frame structure for a facade or glass roof, it is not intended to be limited to the details shown since various modifications and structural changes may be made without departing in any way from the spirit of the present invention.

What is claimed as new and desired to be protected by Letters Patent is set forth in the appended claims:

What is claimed is:

1. A fire resistant frame structure for a facade or glass roof, comprising a first structural element; and a second structural element connectable to the first structural element to form a support construction and so positioned relative to the first structural element as to form bays for receiving a fire-proof glasswork, each of said first and second structural elements being made of aluminum and comprised of a supporting core member for receiving static loads, an enclosure surrounding the core member, connecting means for joining the core member to the enclosure such that a hollow chamber is formed between the core member and the enclosure, and adsorbent material received in the hollow chamber and having heat absorbing and hydrophilic properties, wherein the connecting means provide a low heat conductivity to effect a low heat flux from the enclosure to the core member, wherein the connecting means include bridge members which demarcate the hollow chamber, each said bridge member being provided on its hollow chamber distal side with a groove having a bottom which is formed by at least part of the bridge member, said bottom of the groove being formed with a plurality of spaced punched holes, with webs being formed between successive punched holes to ensure a reduced heat flux from the enclosure to the core member.

2. The frame structure of claim 1, and further comprising a bead of sealing material received in the groove of each bridge member for support of the glasswork.

3. The frame structure of claim 2 wherein the core member has a wall, one of the first and second structural elements being a beam profile, with the bottom of the groove of the beam profile extending in alignment with the wall of the core member.

4. The frame structure of claim 1 wherein the enclosure and the core member are each formed from a single-piece aluminum extrusion.

5. The frame structure of claim 4 wherein the enclosure has a wall thickness, said core member having a wall thickness which is greater than the wall thickness of the enclosure.

6. The frame structure of claim 5, wherein the wall thickness of the core member exceeds the wall thickness of the enclosure by a multiple.

7. The frame structure of claim 1 wherein the core member is a solid element without formation of an inner chamber.

8. The frame structure of claim 1 wherein the core member has a rectangular configuration.

9. The frame structure of claim 1 wherein the adsorbent material is constituted by a formed body made of heat-absorbing, hydrophilic adsorbing substance with high water content.

10. The frame structure of claim 1 wherein the adsorbent material is constituted by a formed body containing a heat-absorbing hydrophilic adsorbing substance.

11. A fire resistant frame structure for a facade or glass roof, comprising a first structural element;

a second structural element connectable to the first structural element to form a support construction and so positioned relative to the first structural element as to form bays for receiving a fire-proof glasswork, each of said first and second structural elements being made of aluminum and comprised of a supporting core member, having a central web which has a configuration of a tuning fork and is formed with a threaded bore, for receiving static loads, an enclosure having a U-shaped box surrounding the core member and having a pair of legs projecting slightly beyond an area of the core member, connecting means for joining the core member to the enclosure such that a hollow chamber is formed between the core member and the enclosure, adsorbent material received in the hollow chamber and having heat absorbing and hydrophilic properties, wherein the connecting means provide a low heat conductivity to effect a low heat flux from the enclosure to the core member, and fire protection strips provided in a glass rebate area on both sides of the threaded bore for bloating under the influence of a temperature rise in case of fire.

12. The frame structure of claim 11 wherein the core member is formed by a rectangular hollow section.

13. The frame structure of claim 11 wherein the area of the core member which is exceeded by the legs of the U-shaped box is formed in one piece with the central web.

14. The frame structure of claims 11 wherein the enclosure and the core member are each formed from a single-piece aluminum extrusion.

15. The frame structure of claim 11 wherein the enclosure has a wall thickness, said core member having a wall thickness which is greater than the wall thickness of the enclosure.

16. The frame structure of claim 15 wherein the wall thickness of the core member exceeds the wall thickness of the enclosure by a multiple.

17. The frame structure of claim 11 wherein the core member is a solid element without formation of an inner chamber.

18. The frame structure of claim 11 wherein the adsorbent material is constituted by a formed body made of heat-absorbing, hydrophilic adsorbing substance with high water content.

19. The frame structure of claim 11 wherein the adsorbent material is constituted by a formed body containing a heat-absorbing hydrophilic adsorbing substance.

20. A fire resistant frame structure for a facade or glass roof, comprising a first structural element; and a second structural element connectable to the first structural element to form a support construction and so positioned relative to the first structural element as to form bays for receiving a fire-proof glasswork, each of said first and second structural elements being made of aluminum and comprised of a supporting core member for receiving static loads, an enclosure surrounding the core member, connecting means for joining the core member to the enclosure such that a hollow chamber is formed between the core member and the enclosure, said connecting means providing a low heat conductivity to effect a low heat flux from the enclosure to the core member, adsorbent material received in the hollow chamber and having heat absorbing and hydrophilic properties, and spring means for securing the adsorbent material in place in a force-locking manner within the hollow chamber.

21. The frame structure of claim 20 wherein the enclosure and the core member are each formed from a single-piece aluminum extrusion.

22. The frame structure of claim 20 wherein the enclosure has a wall thickness, said core member having a wall thickness which is greater than the wall thickness of the enclosure.

23. The frame structure of claim 20 wherein the wall thickness of the core member exceeds the wall thickness of the enclosure by a multiple.

24. The frame structure of claim 20 wherein the core member is a solid element without formation of an inner chamber.

25. The frame structure of claim 20 wherein the core member has a rectangular configuration.

26. The frame structure of claim 20 wherein the adsorbent material is constituted by a formed body made of heat-absorbing, hydrophilic adsorbing substance with high water content.

27. The frame structure of claim 20 wherein the adsorbent material is constituted by a formed body containing a heat-absorbing hydrophilic adsorbing substance.

28. A fire resistant frame structure for a facade or glass roof, comprising a first structural element; and a second structural element connectable to the first structural element to form a support construction and so positioned relative to the first structural element as to form bays for receiving a fire-proof glasswork, each of said first and second structural elements being made of aluminum and comprised of a supporting core member for receiving static loads, said core member including on both sides thereof an anchoring arm which is formed with a longitudinal prismatic edge region and has a plurality of punched holes, an enclosure surrounding the core member and having a receiving groove for engagement by the edge region of the core member, connecting means for joining the core member to the enclosure such that a hollow chamber is formed between the core member and the enclosure, said connecting means providing a low heat conductivity to effect a low heat flux from the enclosure to the core member, and adsorbent material received in the hollow chamber and having heat absorbing and hydrophilic properties.

29. The frame structure of claim 28 wherein the edge region of the anchoring arm is secured through rolling attachment of a flange of the enclosure onto the edge region.

30. The frame structure of claim 28 wherein the connecting means are bridge members, with at least part of each said bridge members forming a bottom of a groove, and further comprising a bead of sealing material received in the groove for support of the glasswork, said groove being flanked by a skirt formed in one piece with and projecting from the anchoring arm and by a flange formed in one piece with and projecting from an outer wall of the enclosure.

31. The frame structure of claim 28 wherein the enclosure and the core member are each formed from a single-piece aluminum extrusion.

32. The frame structure of claim 31 wherein the enclosure has a wall thickness, said core member having a wall thickness which is greater than the wall thickness of the enclosure.

33. The frame structure of claim 32 wherein the wall thickness of the core member exceeds the wall thickness of the enclosure by a multiple.

34. The frame structure of claim 28 wherein the core member is a solid element without formation of an inner chamber.

35. The frame structure of claim 28 wherein the core member has a rectangular configuration.

36. The frame structure of claim 28 wherein the adsorbent material is constituted by a formed body made of heat-absorbing, hydrophilic adsorbing substance with high water content.

37. The frame structure of claim 28 wherein the adsorbent material is constituted by a formed body containing a heat-absorbing hydrophilic adsorbing substance.

38. A fire resistant frame structure for a facade or glass roof, comprising a first structural element; and a second structural element connectable to the first structural element to form a support construction and so positioned relative to the first structural element as to form bays for receiving a fire-proof glasswork, each of said first and second structural elements being made of aluminum and comprised of a supporting core member for receiving static loads, an enclosure surrounding the core member, connecting means for joining the core member to the enclosure such that a hollow chamber is formed between the core member and the enclosure, said connecting means providing a low heat conductivity to effect a low heat flux from the enclosure to the core member, and adsorbent material received in the hollow chamber and having heat absorbing and hydrophilic properties, wherein the core member and the enclosure are formed with grooves for receiving a strip selected from the group consisting of metal strip and connection strip of poorly heat-conducting plastic material, said strip being formed with trapezoidal end pieces secured through interlocking engagement by flanges projecting toward one another from the core member and the enclosure.

39. The frame structure of claim 38 wherein the connecting means are bridge members, with at least part of each said bridge members forming a bottom of a groove, and further comprising a bead of sealing material received in the groove for support of the glasswork, said groove being flanked on one longitudinal side by the strip and on another longitudinal side by an edge region formed in one piece with the enclosure.

40. The frame structure of claim 38 wherein the connection strip is notched for attachment of a metallic bridge panel for effecting a low heat flux from the enclosure to the core member.

41. The frame structure of claim 38 wherein the enclosure and the core member are each formed from a single-piece aluminum extrusion.

42. The frame structure of claim 38 wherein the enclosure has a wall thickness, said core member having a wall thickness which is greater than the wall thickness of the enclosure.

43. The frame structure of claim 42 wherein the wall thickness of the core member exceeds the wall thickness of the enclosure by a multiple.

44. The frame structure of claim 38 wherein the core member is a solid element without formation of an inner chamber.

45. The frame structure of claim 38 wherein the core member has a rectangular configuration.

46. The frame structure of claim 38 wherein the adsorbent material is constituted by a formed body made of heat-absorbing, hydrophilic adsorbing substance with high water content.

47. The frame structure of claim 38 wherein the adsorbent material is constituted by a formed body containing a heat-absorbing hydrophilic adsorbing substance.

48. The frame structure of claim 38 wherein the core member and the enclosure are formed with grooves for receiving a strip selected from the group consisting of metal strip and connection strip of poorly heat-conducting plastic material, said strip being formed with trapezoidal end pieces secured through interlocking engagement by flanges projecting toward one another from the core member and the enclosure.

* * * * *